US010720088B1

(12) United States Patent
Li

(10) Patent No.: US 10,720,088 B1
(45) Date of Patent: Jul. 21, 2020

(54) IMAGE DISPLAY TOTAL CURRENT PREDICTION METHOD, DISPLAY DEVICE AND STORAGE MEDIUM

(71) Applicant: BOE TECHNOLOGY GROUP CO., LTD., Beijing (CN)

(72) Inventor: Zhenzhen Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/539,100

(22) Filed: Aug. 13, 2019

(30) Foreign Application Priority Data

Apr. 12, 2019 (CN) ..... 2019 1 0293742

(51) Int. Cl.
*G09G 3/00* (2006.01)
*G09G 3/3208* (2016.01)
*G09G 3/20* (2006.01)

(52) U.S. Cl.
CPC ..... *G09G 3/006* (2013.01); *G09G 3/2007* (2013.01); *G09G 3/3208* (2013.01); *G09G 2320/0233* (2013.01); *G09G 2360/16* (2013.01)

(58) Field of Classification Search
None
See application file for complete search history.

(56) References Cited

U.S. PATENT DOCUMENTS 10,388,200 B2 * 8/2019 Moon ..... G09G 3/006
2012/0139969 A1 * 6/2012 Yokoyama ..... G09G 3/3233 345/690
2016/0351101 A1 * 12/2016 Lee ..... G09G 3/3225
2019/0206357 A1 * 7/2019 Ahn ..... G09G 3/3655

* cited by examiner

*Primary Examiner* — Duane N Taylor, Jr.
(74) *Attorney, Agent, or Firm* — Collard & Roe, P.C.

(57) ABSTRACT

An image display total current prediction method, a display device and a storage medium. The image display total current prediction method includes: obtaining grayscale signals of respective pixels of an image to be displayed, each of the respective pixels including multiple color channels, and the grayscale signal of each of the respective pixels including multiple color grayscale signals corresponding to the multiple color channels, respectively; calculating average grayscale values of respective color channels of the image to be displayed, respectively, according to the grayscale signals of the respective pixels of the image; based thereon, determining current values of the respective color channels, current bias values of the respective color channels and a total current bias value applied for the image to be displayed, respectively; and based thereon, calculating a display total current prediction value of the image to be displayed.

18 Claims, 5 Drawing Sheets

IMAGE DISPLAY TOTAL CURRENT PREDICTION METHOD, DISPLAY DEVICE AND STORAGE MEDIUM

CROSS-REFERENCE TO RELATED APPLICATION

The present application claims priority of the Chinese Patent Application No. 201910293742.0, filed on Apr. 12, 2019 and entitled "Image Display Total Current Prediction Method, Display Device And Storage Medium", the disclosure of which is incorporated herein by reference in its entirety as part of the present application.

TECHNICAL FIELD

Embodiments of the present disclosure relate to an image display total current prediction method, a display device and a storage medium.

BACKGROUND

When a display panel is displaying, a voltage is divided due to the presence of resistance of a power signal line, so that the voltage from a power terminal to a voltage receiving terminal of a sub-pixel unit drops or rises. This phenomenon is called an IR Drop (voltage drop due to resistance) phenomenon. The sub-pixel units located at different positions in a pixel array of the display panel have different line lengths to the power terminal, so the effects of IR drop on these sub-pixel units can be different. In order to eliminate the influence of the phenomenon that the effects of IR drop on the sub-pixel units located at different positions are different, it is necessary to compensate for the IR drop in the display panel.

SUMMARY

At least one embodiment of the present disclosure provides an image display total current prediction method, which includes: obtaining grayscale signals of respective pixels of an image to be displayed, each of the respective pixels comprising multiple color channels, and the grayscale signal of each of the respective pixels comprising multiple color grayscale signals corresponding to the multiple color channels, respectively; calculating average grayscale values of respective color channels of the image to be displayed, respectively, according to the grayscale signals of the respective pixels of the image to be displayed; determining current values of the respective color channels, current bias values of the respective color channels and a total current bias value applied for the image to be displayed, respectively, according to the average grayscale values of the respective color channels of the image to be displayed; calculating a display total current prediction value of the image to be displayed, according to the current values of the respective color channels, the current bias values of the respective color channels and the total current bias value applied for the image to be displayed.

For example, in the image display total current prediction method provided by some embodiments of the present disclosure, the display total current prediction value is a difference value obtained by subtracting a sum of the current bias values of the respective color channels from a sum of the current values of the respective color channels and then subtracting the total current bias value.

For example, the image display total current prediction method provided by some embodiments of the present disclosure further includes: obtaining test data of a plurality of band point grayscales of the display panel, the plurality of band point grayscales comprising an upper bound grayscale, a lower bound grayscale and a plurality of intermediate grayscales, the test data comprising image current test values upon displaying predetermined color images at each band point grayscale; determining current test values of the respective color channels at each band point grayscale, calculating current bias test values of the respective color channels at each band point grayscale, and calculating a total current bias test value at each band point grayscale, according to the test data.

For example, the image display total current prediction method provided by some embodiments of the present disclosure further includes: according to the current test values of the respective color channels at each band point grayscale, obtaining current test values of the respective color channels at other grayscales by interpolation calculation, so as to obtain a first numerical correspondence relationship between the current test values of the respective color channels and the grayscales; according to the current bias test values of the respective color channels at each band point grayscale, obtaining current bias test values of the respective color channels at other grayscales by interpolation calculation, so as to obtain a second numerical correspondence relationship between the current bias test values of the respective color channels and the grayscales; according to the total current bias test value at each band point grayscale, obtaining total current bias test values at other grayscales by interpolation calculation, so as to obtain a third numerical correspondence relationship between the total current bias test values and the grayscales.

For example, in the image display total current prediction method provided by some embodiments of the present disclosure, the multiple color channels comprises three color channels corresponding to three primary colors, respectively; determining the current values of the respective color channels, the current bias values of the respective color channels and the total current bias value applied for the image to be displayed, respectively, according to the average grayscale values of the respective color channels of the image to be displayed, comprises: determining the current values of the respective color channels according to the average grayscale values of the respective color channels of the image to be displayed and the first numerical value correspondence relationship; determining the current bias values of the respective color channels according to the average grayscale values of the respective color channels of the image to be displayed and the second numerical value correspondence relationship; determining the total current bias value according to the average grayscale values of the respective color channels of the image to be displayed and the third numerical value correspondence relationship.

For example, in the image display total current prediction method provided by some embodiments of the present disclosure, determining the current values of the respective color channels according to the average grayscale values of the respective color channels of the image to be displayed and the first numerical value correspondence relationship comprises: determining current test values of the respective color channels at grayscales corresponding to the average grayscale values of the respective color channels as the current values of the respective color channels.

For example, in the image display total current prediction method provided by some embodiments of the present disclosure, determining the current bias values of the respective color channels according to the average grayscale values of the respective color channels of the image to be displayed and the second numerical value correspondence relationship comprises: judging whether the average grayscale values of the respective color channels are 0 or not; if only one color channel has an average grayscale value that is not 0, determining the current bias value of the one color channel as 0; otherwise, determining current bias test values of the respective color channels at grayscales corresponding to the average grayscale values of the respective color channels as the current bias values of the respective color channels.

For example, in the image display total current prediction method provided by some embodiments of the present disclosure, determining the total current bias value according to the average grayscale values of the respective color channels of the image to be displayed and the third numerical value correspondence relationship comprises: if only one color channel has an average grayscale value that is not 0, determining the total current bias value as 0; if only two color channels have average grayscale values that are not 0, determining a total current bias test value at a grayscale corresponding to an average of the two average grayscale values of the two color channels as the total current bias value; if three average grayscale values of the three color channels are all not 0, determining a total current bias test value at a grayscale corresponding to an average of the three average grayscale values of the three color channels as the total current bias value.

For example, in the image display total current prediction method provided by some embodiments of the present disclosure, the three color channels include a red channel, a green channel and a blue channel, and the predetermined color images include red, green, blue, white, cyan, magenta and yellow images.

For example, in the image display total current prediction method provided by some embodiments of the present disclosure, determining the current test values of the respective color channels at each band point grayscale according to the test data comprises: determining an image current test value of a red image at each band point grayscale as the current test value of the red channel at the each band point grayscale; determining an image current test value of a green image at each band point grayscale as the current test value of the green channel at the each band point grayscale; determining an image current test value of a blue image at each band point grayscale as the current test value of the blue channel at each band point grayscale.

For example, in the image display total current prediction method provided by some embodiments of the present disclosure, calculating the current bias test values of the respective color channels at each band point grayscale and calculating the total current bias test value at each band point grayscale according to the test data comprises: calculating the current bias test values of the respective color channels at each band point grayscale and calculating the total current bias test value at each band point grayscale according to formulas as follows:

$$\begin{cases} deltaR = \mathrm{I_R} + \mathrm{I_C} - \mathrm{I_W} \\ deltaG = \mathrm{I_G} + \mathrm{I_M} - \mathrm{I_W} \\ deltaB = \mathrm{I_B} + \mathrm{I_Y} - \mathrm{I_W} \\ \mathrm{Error} = 2 * \mathrm{I_W} - (\mathrm{I_C} + \mathrm{I_M} + \mathrm{I_Y}) \end{cases}$$

where deltaR is the current bias test value of the red channel at each band point grayscale, deltaG is the current bias test value of the green channel at each band point grayscale, deltaB is the current bias test value of the blue channel at each band point grayscale, Error is the total current bias test value at each band point grayscale, I_R is an image current test value of displaying a red image at each band point grayscale, I_G is an image current test value of displaying a green image at each band point grayscale, I_B is an image current test value of displaying a blue image at each band point grayscale, I_W is an image current test value of displaying a white image at each band point grayscale, I_C is an image current test value of displaying a cyan image at each band point grayscale, I_M is an image current test value of displaying a magenta image at each band point grayscale, and I_Y is an image current test value of displaying a yellow image at each band point grayscale At least one embodiment of the present disclosure further provides a display device, which includes: an image display total current prediction module, configured to obtain the display total current prediction value of the image to be displayed by using the image display total current prediction method provided by any one embodiment of the present disclosure.

For example, in the display device provided by some embodiments of the present disclosure, the image display total current prediction module includes a storage module, and the storage module is configured to store the first numerical correspondence relationship, the second numerical correspondence relationship and the third numerical correspondence relationship.

For example, the display device provided by some embodiments of the present disclosure further includes: a grayscale compensation module, configured to compensate for the grayscale signals of the respective pixels based on the display total current prediction value of the image to be displayed, the grayscale signals of the respective pixels of the image to be displayed, and a predetermined display total current-grayscale compensation relationship.

At least one embodiment of the present disclosure further provides a display device, which includes: a memory, configured to store a computer-readable instruction non-transitorily; and a processor, configured to execute the computer-readable instruction, upon the computer readable instruction being executed by the processor, the image display total current prediction method provided by any one embodiment of the present disclosure being executed.

At least one embodiment of the present disclosure further provides a storage medium, storing computer-readable instructions non-transitorily, upon the computer-readable instructions stored non-transitorily being executed by a computer, instructions for the image display total current prediction method provided by any one embodiment of the present disclosure being executed.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
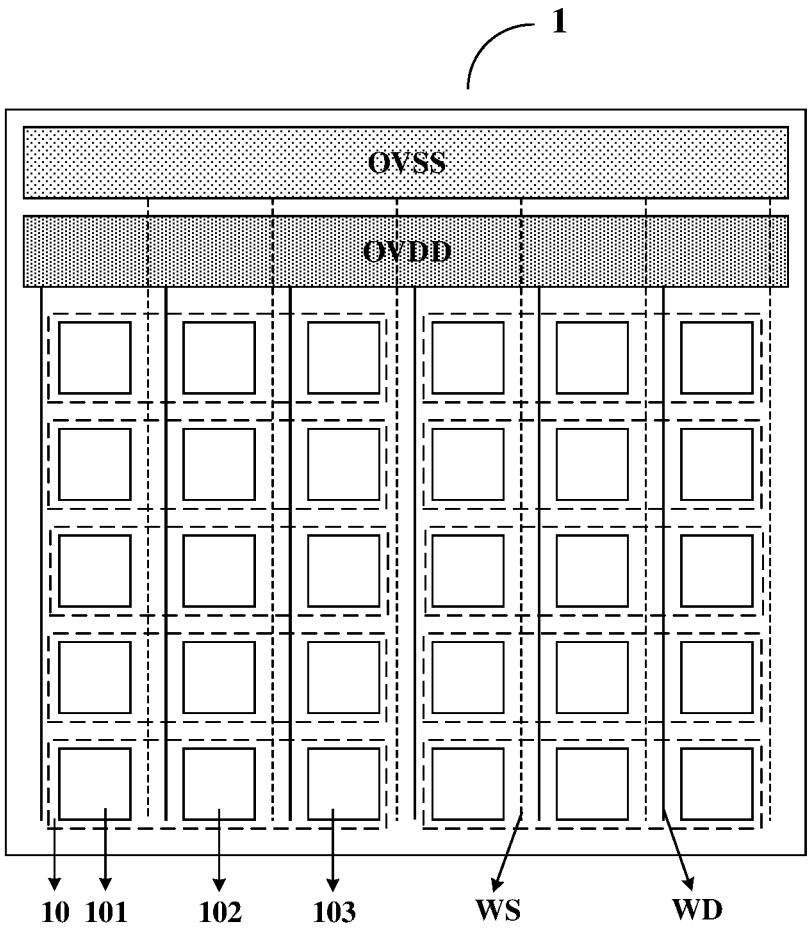
FIG. 1A is a schematic structural diagram of an organic light-emitting diode display panel.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The present disclosure is described below with reference to specific embodiments. In order to keep the following description of the embodiments of the present disclosure clear and concise, detailed descriptions of known functions and known components may be omitted. When any one component of an embodiment of the present disclosure appears in more than one of the accompanying drawings, the component is denoted by a same or similar reference numeral in each of the drawings.

FIG. 1A is a schematic structural diagram of an organic light-emitting diode (OLED) display panel. As shown in FIG. 1A, the organic light emitting diode display panel 1 includes a plurality of pixel units 10 arranged in an array (as shown by the dashed box in FIG. 1A). For example, each of the plurality of pixel units 10 can include a plurality of sub-pixel units, such as a red sub-pixel unit 101, a green sub-pixel unit 102 and a blue sub-pixel unit 103, etc., as shown in FIG. 1A, so that color display can be achieved. For example, each sub-pixel unit includes a pixel driving circuit and an OLED, and the pixel driving circuit is configured to drive the OLED to emit light according to received grayscale voltage signals. For example, a frame of image to be displayed includes a plurality of pixels, and the plurality of pixels are respectively displayed by the plurality of pixel units 10 on the OLED display panel 1. Each pixel of the frame of image to be displayed includes a plurality of sub-pixels, and each of the plurality of sub-pixels displays a primary color, whereby each pixel includes multiple color channels in a one-to-one correspondence with the plurality of sub-pixel units of each pixel unit 10 on the OLED display panel 1. For example, each pixel of the image to be displayed includes a red channel corresponding to the red sub-pixel unit 101, a green channel corresponding to the green sub-pixel unit 102, a blue channel corresponding to the blue sub-pixel unit 103, and etc.

Figure 1B:
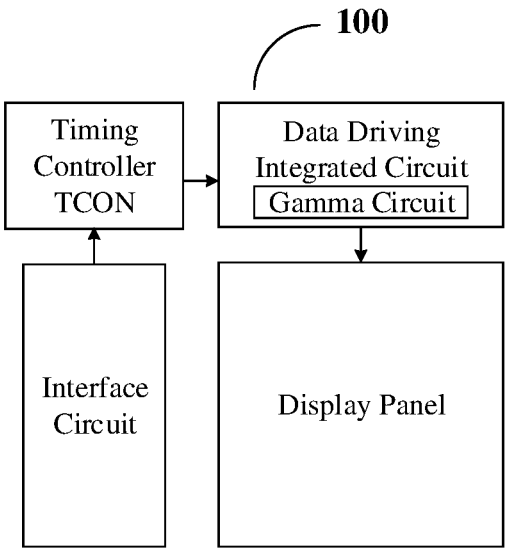
FIG. 1B is a schematic diagram of a display device.

FIG. 1B is a schematic diagram of a display device. As shown in FIG. 1B, the display device 100 includes a display panel. For example, the display panel can be the OLED display panel 1 shown in FIG. 1A, but is not limited thereto. The display device 100 can further include an interface circuit, a timing controller TCON, and a data driving integrated circuit. It should be noted that the display device 100 is only exemplary, and for clarity and conciseness, FIG. 1B has not shown the complete structural components, units or modules of the display device 100.

In order to display images, the display device 100 obtains image data from a data source through the interface circuit, and transforms the obtained image data into a data signal (i.e., grayscale digital signal, grayscale signal for short) applicable for the data driving integrated circuit through the timing controller (TCON), then the data driving integrated circuit performs digital-to-analog conversion on the transformed grayscale signal to convert the grayscale signal into a corresponding analog voltage signal, and inputs the analog voltage signal into a pixel unit of the display panel to control the pixel driving circuit driving a light emitting element (i.e., the OLED) to emit light. As described above, in order to eliminate the influence of the phenomenon that the effects of IR drop on the sub-pixel units located at different positions are different, it is necessary to compensate for the IR drop in the display panel. An IR drop compensation method is to obtain a display total current of a frame of image displayed by a display panel, and compensate for a next frame of image to be displayed based on the display total current.

When displaying one frame of image, the OLED display panel 1 needs to obtain grayscale signals of respective pixels of the frame of image, and the grayscale signal of each pixel include multiple color grayscale signals corresponding to the multiple color channels, respectively. During displaying, the color grayscale signal of each color channel of each pixel can control the brightness of the sub-pixel unit corresponding to the color channel, so that light of different colors emitted by the plurality of sub-pixel units are mixed with each other to generate a required color, and thus, each pixel unit can display a pixel of the image corresponding to the pixel unit.

The OLED is a current driving element. As shown in FIG. 1A, in order to provide a driving voltage to the pixel unit, the OLED display panel 1 further includes a first power terminal OVDD and a second power terminal OVSS. The first power terminal OVDD is electrically connected to the plurality of sub-pixel units 101, 102, 103 through a first power line WD (as shown by the solid line in FIG. 1A), so as to provide a first power voltage VDD (e.g., high voltage) to the plurality of sub-pixel units 101, 102, 103 through the first power line WD. The second power terminal OVSS is electrically connected to the plurality of sub-pixel units 101, 102, 103 through a second power line WS (as shown by the dashed line in FIG. 1A), so as to provide a second power voltage VSS (e.g., low voltage, such as ground voltage) to the plurality of sub-pixel units 101, 102, 103 through the second power line WS.

When the OLED display panel 1 performs display by using the plurality of pixel units 10 arranged in the array as described above, there may exist an IR drop phenomenon. The IR drop phenomenon is particularly noticeable in a large-sized display in which an OLED display panel 1 is applied. For example, because the first power line WD inevitably has a certain resistance, a first power voltage VDD1 actually received by the sub-pixel units 101, 102 and 103 close to the first power terminal OVDD is higher than a first power voltage VDD2 actually received by the sub-pixel units 101, 102 and 103 away from the first power terminal OVDD in the OLED display panel 1, and the first power voltage VDD1 and the first power voltage VDD2 are both lower than the original first power voltage VDD provided by the first power terminal OVDD. For example, similarly, because the second power line WS inevitably has a certain resistance, a second power voltage VSS1 actually received by the sub-pixel units 101, 102 and 103 close to the second power terminal OVSS is lower than a second power voltage VSS2 actually received by the sub-pixel units 101, 102 and 103 away from the second power terminal OVSS in the OLED display panel 1, and the second power voltage VSS1 and the second power voltage VSS2 are both higher than the original second power voltage VSS provided by the second power terminal OVSS.

When the OLED display panel 1 performs display, due to the existence of the IR drop phenomenon, the pixel units 10 in different regions may display different brightness in a case where the pixel units 10 are set to display the same grayscale, thereby resulting in display unevenness, and causing mura phenomenon and thereby affecting the display performance. In order to solve the above problem, a compensation method may include: acquiring a display total current when displaying a frame of image by a current sensing element or a circuit or the like disposed on the OLED display panel 1; taking the display total current as a display total current of a next frame of image to be displayed, and compensating for the grayscale signals of the respective pixels of the next frame of image to be displayed according to the grayscale signals of the respective pixels of the next frame of image to be displayed and a predetermined display total current-grayscale compensation relationship. It should be noted that the mura phenomenon may also be caused by other reasons (for example, threshold voltage shift of the driving transistor in the pixel unit, or aging of the OLED itself, etc.), and the above reason is not limitative in the present disclosure.

In research, it is noticed that: in the above compensation method, the display total current of the next frame of image to be displayed is predicted by acquiring the display total current of the frame of image being displayed, and then the next frame of image to be displayed is compensated, which causes a delay to some degree in the compensation process. The above compensation method has a relatively good compensation effect when the display pictures are stable and continuous (that is, a change between the brightness of a former frame and the brightness of a latter frame is small), and has a relatively poor compensation effect when the display pictures change dramatically (that is, a change between the brightness of a former frame and the brightness of a latter frame is great). In addition, in the above compensation method, it is also necessary to additionally provide a current sensing element or circuit, etc., thereby increasing a production cost of the OLED display panel and reduces a yield of the OLED display panel.

At least one embodiment of the present disclosure provides an image display total current prediction method, which includes: obtaining grayscale signals of respective pixels of an image to be displayed, each of the respective pixels including multiple color channels, and the grayscale signal of each of the respective pixels including multiple color grayscale signals corresponding to the multiple color channels, respectively; calculating average grayscale values of respective color channels of the image to be displayed, respectively, according to the grayscale signals of the respective pixels of the image to be displayed; determining current values of the respective color channels, current bias values of the respective color channels and a total current bias value applied for the image to be displayed, respectively, according to the average grayscale values of the respective color channels of the image to be displayed; calculating a display total current prediction value of the image to be displayed, according to the current values of the respective color channels, the current bias values of the respective color channels and the total current bias value applied for the image to be displayed.

Some embodiments of the present disclosure also provides a display device and a storage medium corresponding to the image display total current prediction method described above.

The image display total current prediction method provided by the embodiments of the present disclosure can predict the display total current of the image to be displayed according to the grayscale signals of the respective pixels of the image to be displayed. Based on the display total current predicted by the image display total current prediction method, the image to be displayed can be compensated in real time, so that compensation rate and compensation accuracy of the display panel are improved, and the compensation effect is improved. At the same time, the image display total current prediction method does not require an additional current sensing element or circuit, etc., and has advantages of simple implementation and low cost.

Embodiments of the present disclosure and examples thereof will be described in detail below with reference to the accompanying drawings.

Figure 2:
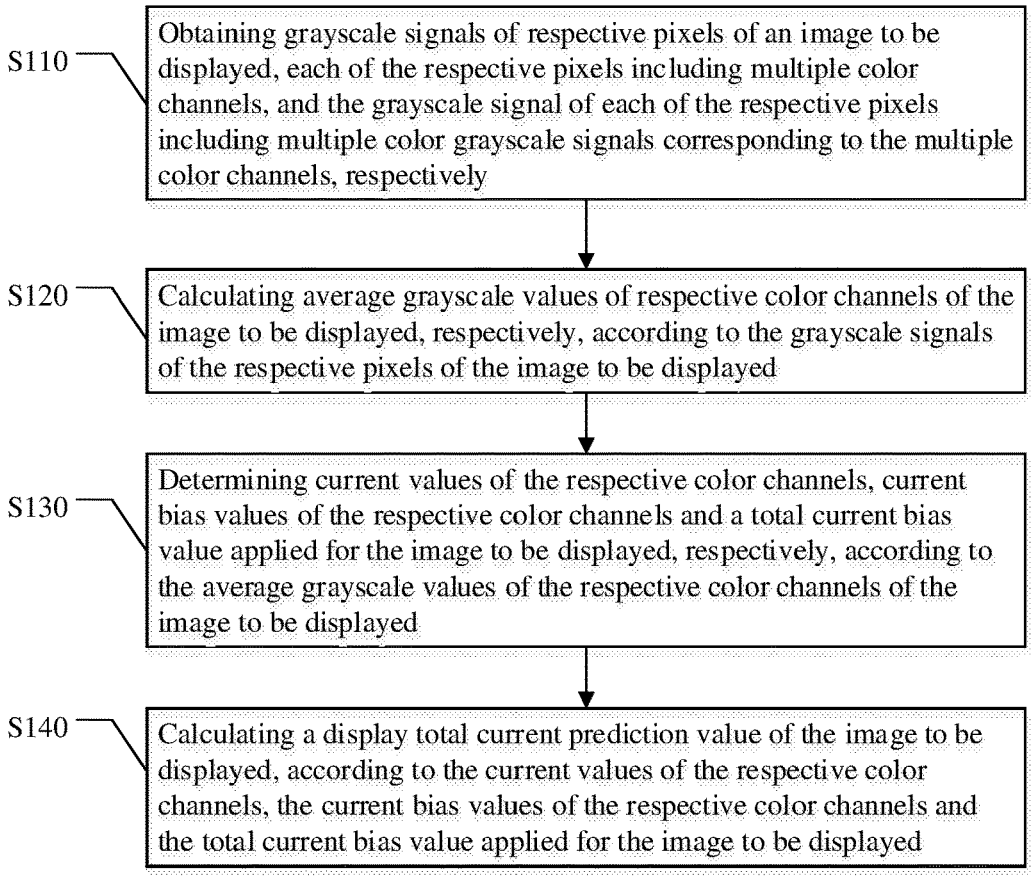
FIG. 2 is a flowchart of an image display total current prediction method provided by some embodiments of the present disclosure.

FIG. 2 is a flowchart of an image display total current prediction method provided by some embodiments of the present disclosure. For example, the image display total current prediction method can be used to predict a display total current when a display panel is displaying a frame of image. For example, the display panel can be the OLED display panel as shown in FIG. 1A, and can also be a quantum dot light-emitting diode (QLED) display panel, an inorganic light-emitting diode display panel, etc. However, those cases are not limitative in the present disclosure.

As shown in FIG. 2, the image display total current prediction method includes steps S110 to S140.

Step S110: obtaining grayscale signals of respective pixels of an image to be displayed, each of the respective pixels including multiple color channels, and the grayscale signal of each of the respective pixels including multiple color grayscale signals corresponding to the multiple color channels, respectively.

For example, the image to be displayed is a frame of image to be displayed immediately by the display panel, and the frame of image includes a plurality of pixels. For example, each pixel of the frame of image corresponds to one pixel unit (for example, one pixel unit 10 shown in FIG. 1A) on the display panel, and is displayed by the pixel unit.

For example, each sub-pixel unit on the display panel corresponds to one color channel. For example, the multiple color channels can include three color channels corresponding to three primary colors, respectively. For example, the three primary colors includes red, green and blue, and the present disclosure includes the above case but is not limited thereto.

The following description is illustrated by taking that each pixel of the image to be displayed includes three color channels of red, green and blue as an example. Accordingly, as shown in FIG. 1A, each pixel unit 10 on the display panel includes a red sub-pixel unit 101 (corresponding to the red channel), a green sub-pixel unit 102 (corresponding to the green channel), and a blue sub-pixel unit 103 (corresponding to the blue channel).

For example, the grayscale signal of each pixel includes three color grayscale signals corresponding to the three color channels of red, green and blue. That is, the grayscale signal of each pixel includes a red grayscale signal, a green grayscale signal, and a blue grayscale signal.

Step S120: calculating average grayscale values of respective color channels of the image to be displayed, respectively, according to the grayscale signals of the respective pixels of the image to be displayed.

For example, the average grayscale value of each color channel of the image to be displayed is an average value obtained by summing the corresponding color grayscale signals of all pixels of the image to be displayed and then averaging.

For example, an average grayscale value of the red channel is obtained by summing red color grayscale signals of all pixels of the image to be displayed and then averaging. An average grayscale value of the green channel is obtained by summing green color grayscale signals of all pixels of the image to be displayed and then averaging. And, an average grayscale value of the blue channel is obtained by summing blue color grayscale signals of all pixels of the image to be displayed and then averaging.

Step S130: determining current values of the respective color channels, current bias values of the respective color channels and a total current bias value applied for the image to be displayed, respectively, according to the average grayscale values of the respective color channels of the image to be displayed.

For example, based on the average grayscale values of the respective color channels of the image to be displayed, the current values of the respective color channels can be determined according to a predetermined numerical value correspondence relationship between current test values of the respective color channels and grayscales, the current bias values of the respective color channels can be determined according to a predetermined numerical value correspondence relationship between current bias test values of the respective color channels and grayscales, and the total current bias value can be determined according to a predetermined numerical value correspondence relationship between total current bias test values and grayscales.

Taking that each pixel of the image to be displayed includes three color channels of red, green and blue as an example, if the display panel displays monochromatic images (monochromatic images may include red images, green images, and blue images), the current bias values of the respective color channels and the total current bias value are not involved when predicting the display total current. That is, the current bias values of the respective color channels and the total current bias value are 0. If the display panel displays non-monochromatic images (non-monochromatic images may include images other than monochromatic images, such as white images, cyan images, magenta images and yellow images, and etc.), the current bias values of the respective color channels and the total current bias value are involved when predicting the display total current.

Taking that the display panel displays a white image as an example, the white image is composed of a red image, a green image, and a blue image with the same grayscale. Ideally, a display total current of the white image is the sum of a display total current of the display panel displaying the red image, a display total current of the display panel displaying the green image, and a display total current of the display panel displaying the blue image. However, due to the existence of factors such as IR drop, an actual display total current of the white image shows a deviation from the sum of the above three. Of course, there exists similar deviations when the display panel displays other non-monochromatic images.

After research work, the inventor of the present application found that by introducing the current bias value of the red channel, the current bias value of the green channel, the current bias value of the blue channel and the total current bias value of the image to be displayed, to characterize the influence of the factors such as IR drop, etc., the above deviations can be represented accurately, and further, the display total current prediction value with high accuracy can be obtained.

Step S140: calculating a display total current prediction value of the image to be displayed, according to the current values of the respective color channels, the current bias values of the respective color channels and the total current bias value applied for the image to be displayed.

For example, the display total current prediction value of the image to be displayed is a difference value obtained by subtracting a sum of the current bias values of the respective color channels from a sum of the current values of the respective color channels and then subtracting the total current bias value.

Taking that each pixel of the image to be displayed includes three color channels of red, green and blue as an example, a current value of the red channel, a current value of the green channel and a current value of the blue channel obtained in step S130 are summed to obtain a first value, a current bias value of the red channel, a current bias value of the green channel and a current bias value of the blue channel obtained in step S130 are summed to obtain a second value. The display total current prediction value of the image to be displayed can be obtained by subtracting the second value from the first value and then subtracting the total current bias value obtained in step S130.

It should be noted that human eyes are more sensitive to brightness in a dark environment than in a bright environment. It has been found by researches that the sensation of human eyes is approximately proportional to $(1/\gamma)$ power of the brightness. A relationship curve of the sensation of human eyes and the brightness is called a Gamma curve, and y is a Gamma value. The Gamma value usually meets the requirement of human eyes for a linear relationship between brightness change and grayscale change when the Gamma value is at 2.0-2.4. Generally, the Gamma value takes an intermediate value of 2.2. Generally, in order to make the display effect of the display device more in line with the visual curve of human eyes, Gamma tuning is required when the display panel is displaying. For example, as shown in FIG. 1B, in the display device 100, the Gamma tuning can be performed by a Gamma circuit included in the data driving integrated circuit.

Figure 3:
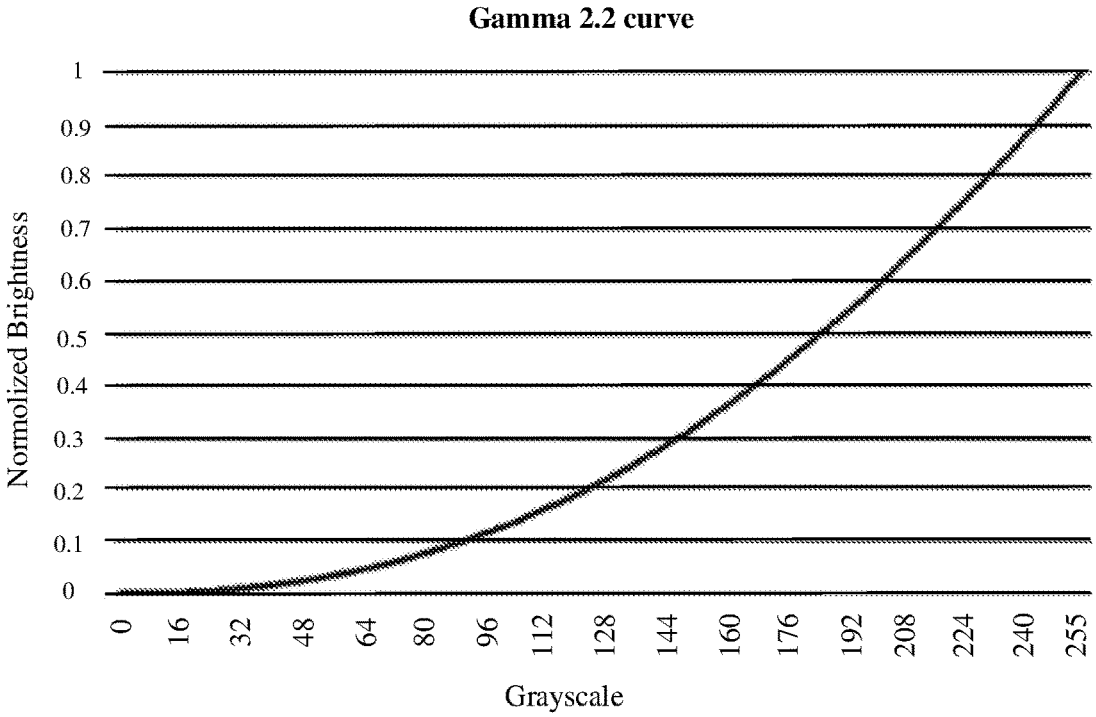
FIG. 3 is a schematic diagram of a Gamma 2.2 curve.

FIG. 3 is a schematic diagram of a Gamma 2.2 curve (i.e., a Gamma curve with a Gamma value of 2.2). According to the Gamma 2.2 curve shown in FIG. 3, for each sub-pixel unit, the relationship between the brightness (shown as normalized brightness in FIG. 3) and the grayscale is nonlinear. Taking the OLED display panel 1 shown in FIG. 1A as an example, the brightness of each sub-pixel unit is proportional to the driving current, so that the relationship between the driving current of each sub-pixel unit and the grayscale is nonlinear. Therefore, the numerical value correspondence relationship between the current test values of the respective color channels and the grayscales, the numerical value correspondence relationship between the current bias test values of the respective color channels and the grayscales and the numerical value correspondence relationship between the total current bias test values and the grayscales, mentioned in step S130, can be measured in advance.

Figure 4:
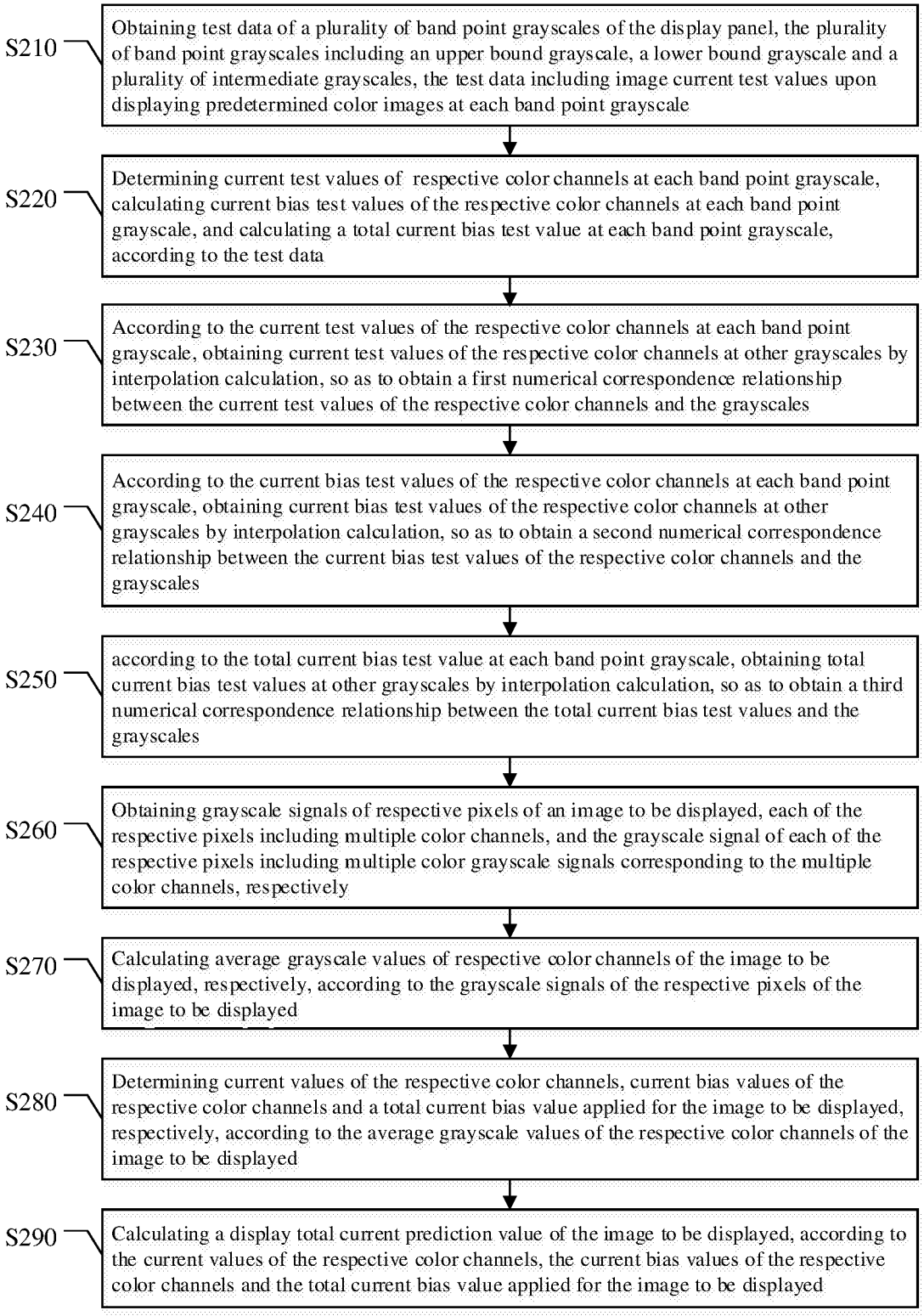
FIG. 4 is a flowchart of another image display total current prediction method provided by some embodiments of the present disclosure.

FIG. 4 is a flowchart of another image display total current prediction method provided by some embodiments of the present disclosure.

As shown in FIG. 4, the image display total current prediction method includes steps S210 to S290.

Steps S210 to S250 of the image display total current prediction method shown in FIG. 4 provide a method of measuring the numerical value correspondence relationship between current test values of the respective color channels and grayscales, the numerical value correspondence relationship between current bias test values of the respective color channels and grayscales and the numerical value correspondence relationship between total current bias test values and grayscales, mentioned in step S130, in advance.

Steps S260 to S290 of the image display total current prediction method shown in FIG. 4 are the same as steps S110 to S140 of the image display total current prediction method shown in FIG. 2, correspondingly, that is, the prediction method shown in FIG. 4 includes the prediction method shown in FIG. 2. Therefore, steps S260 to S290 of the image display total current prediction method shown in FIG. 4 can be referred to the foregoing description of steps S110 to S140 of the image display total current prediction method shown in FIG. 2. Hereinafter, steps S210 to S290 of the image display total current prediction method shown in FIG. 4 will be described in detail.

Step S210: obtaining test data of a plurality of band point grayscales of the display panel, the plurality of band point grayscales including an upper bound grayscale, a lower bound grayscale and a plurality of intermediate grayscales, the test data including image current test values upon displaying predetermined color images at each band point grayscale.

For example, a grayscale signal can be an 8-bit digital signal, and the value range thereof is from 0 to 255 (as shown in FIG. 3); alternatively, a grayscale signal can be a 12-bit digital signal, and the value range thereof is from 0 to 4095. It should be noted that the present disclosure is described by taking that the value range of the grayscale signal is from 0 to 255 as an example, which is not limitative in the present disclosure.

For example, a certain number of sample grayscales can be selected from the grayscales of 0 to 255 as the band point grayscales (i.e., benchmark grayscales), so that a segment of the Gamma curve between any adjacent two band point grayscales can be approximated as a straight line. Therefore, as long as the current test values of any one color channel at the adjacent two band point grayscales are measured, a current test value of the one color channel at any other grayscale between the adjacent two band point grayscales can be calculated by linear interpolation. Because the current test values at the upper bound grayscale 255 and the lower bound grayscale 0 cannot be calculated by the above linear interpolation method, the plurality of band point grayscales in step S210 should include the upper bound grayscale 255, the lower bound grayscale 0, and a plurality of intermediate grayscales. It should be noted that there may be no other grayscales between some adjacent two band point grayscales, which is not limitative in the present disclosure. It should also be noted that the present disclosure does not limit the specific number of the plurality of band point grayscales.

For example, in step S260 (referring to step S110 described above), which will be described in the following, each pixel of the image to be displayed includes multiple color channels. For example, the multiple color channels can include three color channels corresponding to three primary colors, respectively. For example, the three primary colors are a red color, a green color, and a blue color, and the present disclosure includes but is not limited to this case.

Taking that each pixel of the image to be displayed includes a red channel, a green channel and a blue channel as an example, accordingly, the predetermined color images in step S210 include red (R), green (G), blue (B), white (W), cyan (C), magenta (M) and yellow (Y) images. R+G=Y, G+B=C, R+B=M, that is, yellow, cyan and magenta are a mixture of two primary colors. Therefore, they are also called additive secondary colors. R+G+B=W, therefore, white color carries the characteristics of the corresponding three primary colors.

Therefore, in step S210, by causing the display panel to display the predetermined color images at each band point grayscale and measuring the display total current of each predetermined color image, the following test data can be obtained: an image current test value of displaying a red image at each band point grayscale, an image current test value of displaying a green image at each band point grayscale, an image current test value of displaying a blue image at each band point grayscale, an image current test value of displaying a white image at each band point grayscale, an image current test value of displaying a cyan image at each band point grayscale, an image current test value of displaying a magenta image at each band point grayscale, an image current test value of displaying a yellow image at each band point grayscale.

For example, the measurement can be performed by a panel test device external to the display panel, such as a light-on test device, etc., so as to obtain the test data as described above.

Step S220: determining current test values of respective color channels at each band point grayscale, calculating current bias test values of the respective color channels at each band point grayscale, and calculating a total current bias test value at each band point grayscale, according to the test data.

Taking that each pixel of the image to be displayed includes a red channel, a green channel and a blue channel as an example, in step S220, the determining current test values of the respective color channels at each band point grayscale according to the test data obtained in step S210 can comprise: determining an image current test value of a red image at each band point grayscale as the current test value of the red channel at the each band point grayscale; determining an image current test value of a green image at each band point grayscale as the current test value of the green channel at the each band point grayscale; and determining an image current test value of a blue image at each band point grayscale as the current test value of the blue channel at each band point grayscale. That is, the image current test values of the three primary color images corresponding to the three color channels are determined as the current test value of the respective three color channels.

Taking that each pixel of the image to be displayed includes a red channel, a green channel and a blue channel as an example, in step S220, as to the calculating current bias test values of the respective color channels at each band point grayscale and the calculating a total current bias test value at each band point grayscale according to the test data obtained in step S210, the current bias test values of the respective color channels at each band point grayscale and the total current bias test value at each band point grayscale can be calculated according to formulas as follows:

$$\begin{cases} deltaR = \text{I_R} + \text{I_C} - \text{I_W} \\ deltaG = \text{I_G} + \text{I_M} - \text{I_W} \\ deltaB = \text{I_B} + \text{I_Y} - \text{I_W} \\ \text{Error} = 2 * \text{I_W} - (\text{I_C} + \text{I_M} + \text{I_Y}) \end{cases}$$

where deltaR is the current bias test value of the red channel at each band point grayscale, deltaG is the current bias test value of the green channel at each band point grayscale, deltaB is the current bias test value of the blue channel at each band point grayscale, Error is the total current bias test value at each band point grayscale, I_R is an image current test value of displaying a red image at each band point grayscale, I_G is an image current test value of displaying a green image at each band point grayscale, I_B is an image current test value of displaying a blue image at each band point grayscale, I_W is an image current test value of displaying a white image at each band point grayscale, I_C is an image current test value of displaying a cyan image at each band point grayscale, I_M is an image current test value of displaying a magenta image at each band point grayscale, I_Y is an image current test value of displaying a yellow image at each band point grayscale.

It should be noted that, in the present example, a white image is composed of a red image, a green image, and a blue image of the same grayscale; a cyan image is composed of a green image and a blue image of the same grayscale; a magenta image is composed of a red image and a blue image of the same gray scale; and a yellow image is composed of a red image and a green image of the same gray scale. In the present example, a red image, a green image, and a blue image are all monochromatic images, and a monochromatic image requires sub-pixel units of only one color for displaying. A white image, a cyan image, a magenta image, and a yellow image are all non-monochromatic images, and a non-monochromatic image requires sub-pixel units of two or more colors for displaying.

Step S230: according to the current test values of the respective color channels at each band point grayscale, obtaining current test values of the respective color channels at other grayscales by interpolation calculation, so as to obtain a first numerical correspondence relationship between the current test values of the respective color channels and the grayscales.

Taking that each pixel of the image to be displayed includes a red channel, a green channel and a blue channel as an example, as to any other grayscale not belonging to the band point grayscale that is different from the band point grayscales selected in step S210, the current test values of the respective color channels at the grayscale not belonging to the band point grayscales can be calculated by linear interpolation based on formulas as follows:

$$\begin{cases} \text{I_R}(X) = \text{I_R}(X1) + \dfrac{\text{I_R}(X2) - \text{I_R}(X1)}{X2 - X1}(X - X1) \\ \text{I_G}(X) = \text{I_G}(X1) + \dfrac{\text{I_G}(X2) - \text{I_G}(X1)}{X2 - X1}(X - X1) \\ \text{I_B}(X) = \text{I_B}(X1) + \dfrac{\text{I_B}(X2) - \text{I_B}(X1)}{X2 - X1}(X - X1) \end{cases}$$

where X is a grayscale not belonging to the band point grayscales, X1 is a band point grayscale adjacent to the grayscale not belonging to the band point grayscales on the left, X2 is a band point grayscale adjacent to the grayscale not belonging to the band point grayscales on the right, I_R(X1), I_G(X1) and I_B(X1) are the current test value of the red channel, the current test value of the green channel and the current test value of the blue channel at the band point grayscale X1, respectively, I_R(X2), I_G(X2) and I_B(X2) are the current test value of the red channel, the current test value of the green channel and the current test value of the blue channel at the band point grayscale X2, respectively, I_R(X), I_G(X) and I_B(X) are the current test value of the red channel, the current test value of the green channel and the current test value of the blue channel at the grayscale X to be calculated, respectively.

It should be noted that, the adjacent band point grayscale X1 on the left is a band point grayscale less than the grayscale X and closest to the grayscale X, and the adjacent band point grayscale X2 on the right is a band point grayscale greater than the grayscale X and closest to the grayscale X. Therefore, the current test values of the respective color channels at all of the grayscales not belonging to the band point grayscales can be obtained by linear interpolation calculation, and together with the current test values of the respective color channels at all of the band point grayscales, the first numerical correspondence relationship between the current test values of the respective color channels and the (all) grayscales can be obtained.

For example, the first numerical correspondence relationship can be stored in a memory of the display device. For example, the first numerical correspondence relationship can be stored in a storage medium of the memory. For example, when the first numerical correspondence relationship stored in the storage medium is called by a computer, the first numerical correspondence relationship can be presented in a form of, for example, table or graph.

It should be noted that, the interpolation method in step S230 includes but is not limited to a linear interpolation method, and can be any other suitable interpolation method, such as polynomial interpolation, etc., which is not limitative in the present disclosure.

Step S240: according to the current bias test values of the respective color channels at each band point grayscale, obtaining current bias test values of the respective color channels at other grayscales by interpolation calculation, so as to obtain a second numerical correspondence relationship between the current bias test values of the respective color channels and the grayscales.

Taking that each pixel of the image to be displayed includes a red channel, a green channel and a blue channel as an example, as to any other grayscale not belonging to the band point grayscale that is different from the band point grayscales selected in step S210, the current bias test values of the respective color channels at the grayscale not belonging to the band point grayscales can be calculated by linear interpolation based on formulas as follows:

$$\begin{cases} deltaR(X) = deltaR(X1) + \frac{deltaR(X2) - deltaR(X1)}{X2 - X1}(X - X1) \\ deltaG(X) = deltaG(X1) + \frac{deltaG(X2) - deltaG(X1)}{X2 - X1}(X - X1) \\ deltaB(X) = deltaB(X1) + \frac{deltaB(X2) - deltaB(X1)}{X2 - X1}(X - X1) \end{cases}$$

where X is a grayscale not belonging to the band point grayscales, X1 is a band point grayscale adjacent to the grayscale not belonging to the band point grayscales on the left, X2 is a band point grayscale adjacent to the grayscale not belonging to the band point grayscales on the right, deltaR(X1), deltaG(X1) and deltaB(X1) are the current bias test value of the red channel, the current bias test value of the green channel and the current bias test value of the blue channel at the band point grayscale X1, respectively, deltaR (X2), deltaG(X2) and deltaB(X2) are the current bias test value of the red channel, the current bias test value of the green channel and the current bias test value of the blue channel at the band point grayscale X2, respectively, deltaR (X), deltaG(X) and deltaB(X) are the current bias test value of the red channel, the current bias test value of the green channel and the current bias test value of the blue channel at the grayscale X to be calculated, respectively. It should be noted that, the definitions of the adjacent band point grayscale X1 on the left and the adjacent band point grayscale X2 on the right here are the same as those in step S230, and are not repeatedly described herein. Therefore, the current bias test values of the respective color channels at all of the grayscales not belonging to the band point grayscales can be obtained by linear interpolation calculation, and together with the current bias test values of the respective color channels at all of the band point grayscales, the second numerical correspondence relationship between the current bias test values of the respective color channels and the (all) grayscales can be obtained.

For example, the second numerical correspondence relationship can also be stored in the memory of the display device. For example, the second numerical correspondence relationship can also be stored in the storage medium of the memory. For example, when the second numerical correspondence relationship stored in the storage medium is called by a computer, the second numerical correspondence relationship can be presented in a form of, for example, table or graph.

It should be noted that, the interpolation method in step S240 includes but is not limited to a linear interpolation method, and can be any other suitable interpolation method, such as polynomial interpolation, etc., which is not limitative in the present disclosure. For example, the interpolation method in step S240 can be the same as the interpolation method in step S230.

Step S250: according to the total current bias test value at each band point grayscale, obtaining total current bias test values at other grayscales by interpolation calculation, so as to obtain a third numerical correspondence relationship between the total current bias test values and the grayscales.

For example, as to any other grayscale not belonging to the band point grayscale that is different from the band point grayscales selected in step S210, the total current bias test value at the grayscale not belonging to the band point grayscales can be calculated by linear interpolation based on a formula as follows:

$$Error(X) = Error(X1) + \frac{Error(X2) - Error(X1)}{X2 - X1}(X - X1)$$

where X is a grayscale not belonging to the band point grayscales, X1 is a band point grayscale adjacent to the grayscale not belonging to the band point grayscales on the left, X2 is a band point grayscale adjacent to the grayscale not belonging to the band point grayscales on the right, Error(X1) is the total current bias test value at the band point grayscale X1, Error(X2) is the total current bias test value at the band point grayscale X2, Error(X) is the total current bias test value at the grayscale X to be calculated. It should be noted that, the definitions of the adjacent band point grayscale X1 on the left and the adjacent band point grayscale X2 on the right here are the same as those in steps S230 and S240, and are not repeatedly described herein. Therefore, the total current bias test values at all of the grayscales not belonging to the band point grayscales can be obtained by linear interpolation calculation, and together with the total current bias test values at all of the band point grayscales, the third numerical correspondence relationship between the total current bias test values and the (all) grayscales can be obtained.

For example, the third numerical correspondence relationship can also be stored in the memory of the display device. For example, the third numerical correspondence relationship can also be stored in the storage medium of the memory. For example, when the third numerical correspondence relationship stored in the storage medium is called by a computer, the third numerical correspondence relationship can be presented in a form of, for example, table or graph.

It should be noted that, the interpolation method in step S250 includes but is not limited to a linear interpolation method, and can be any other suitable interpolation method, such as polynomial interpolation, etc., which is not limitative in the present disclosure. For example, the interpolation method in step S250 can be the same as the interpolation methods in steps S230 and S240.

It should be noted that, based on the first numerical correspondence relationship, the second numerical correspondence relationship, and the third numerical correspondence relationship obtained in steps S210 to S250 described above, the image display total current of a display panel having the same specifications as the tested display panel (that is, having the same design parameters) can be predicted. That is, the image to be displayed in the subsequent steps S260 to S290 is not necessary to be displayed by the tested display panel, but can be displayed by any one display panel having the same specifications as the tested display panel.

Step S260: obtaining grayscale signals of respective pixels of an image to be displayed, each of the respective pixels including multiple color channels, and the grayscale signal of each of the respective pixels including multiple color grayscale signals corresponding to the multiple color channels, respectively.

Taking that each pixel of the image to be displayed includes a red channel, a green channel and a blue channel as an example, accordingly, the grayscale signal of each pixel includes a red grayscale signal, a green grayscale signal, and a blue grayscale signal.

Step S270: calculating average grayscale values of respective color channels of the image to be displayed, respectively, according to the grayscale signals of the respective pixels of the image to be displayed.

Taking that each pixel of the image to be displayed includes a red channel, a green channel and a blue channel as an example, accordingly, an average grayscale value of the red channel is obtained by summing red color grayscale signals of all pixels of the image to be displayed and then averaging, an average grayscale value of the green channel is obtained by summing green color grayscale signals of all pixels of the image to be displayed and then averaging, and an average grayscale value of the blue channel is obtained by summing blue color grayscale signals of all pixels of the image to be displayed and then averaging.

For example, the average grayscale value of the red channel, the average grayscale value of the green channel, and the average grayscale value of the blue channel can be rounded off.

Step S280: determining current values of the respective color channels, current bias values of the respective color channels and a total current bias value applied for the image to be displayed, respectively, according to the average grayscale values of the respective color channels of the image to be displayed.

For example, in step S280, the current values of the respective color channels can be determined according to the average grayscale values of the respective color channels of the image to be displayed and the first numerical correspondence relationship described above. For example, the current test value of any one color channel at a grayscale corresponding to the average grayscale value of the color channel of the image to be displayed can be determined as the current value of the color channel.

Taking that each pixel of the image to be displayed includes a red channel, a green channel and a blue channel as an example, according to the first numerical correspondence relationship described above, the current test value of the red channel at a grayscale corresponding to the average grayscale value of the red channel can be determined as the current value of the red channel I(p)_R, the current test value of the green channel at a grayscale corresponding to the average grayscale value of the green channel can be determined as the current value of the green channel I(p)_G, and the current test value of the blue channel at a grayscale corresponding to the average grayscale value of the blue channel can be determined as the current value of the blue channel I(p)_B.

For example, in step S280, the current bias values of the respective color channels can be determined according to the average grayscale values of the respective color channels of the image to be displayed and the second numerical correspondence relationship described above. For example, first, judge whether the average grayscale values of the respective color channels are 0 or not; if only one color channel has an average grayscale value that is not 0, determine the current bias value of the one color channel as 0; otherwise, determine the current bias test values of the respective color channels at grayscales corresponding to the average grayscale values of the respective color channels as the current bias values of the respective color channels.

The following description is illustrated by taking that each pixel of the image to be displayed includes a red channel, a green channel and a blue channel as an example. If only one color channel has an average grayscale value that is not 0, it indicates that the display panel is displaying a monochromatic image. In this case, the current bias values of the respective color channels are not involved, that is, the current bias values of the respective color channels are determined to be 0. If two or more color channels have average grayscale values that are not 0, it indicates that the display panel is displaying a non-monochromatic image. In this case, the current bias values of the respective color channels are involved, the current bias test value of the red channel at a grayscale corresponding to the average grayscale value of the red channel is determined as the current bias value of the red channel, the current bias test value of the green channel at a grayscale corresponding to the average grayscale value of the green channel is determined as the current bias value of the green channel, and the current bias test value of the blue channel at a grayscale corresponding to the average grayscale value of the blue channel is determined as the current bias value of the blue channel. Therefore, the current bias value of the red channel deltaR (p), the current bias value of the green channel deltaG(p) and the current bias value of the blue channel deltaB(p) when the display panel is displaying can be obtained.

For example, in step S280, the total current bias value can be determined according to the average grayscale values of the respective color channels of the image to be displayed and the third numerical correspondence relationship described above.

The following description is illustrated by taking that each pixel of the image to be displayed includes three color channels (for example, a red channel, a green channel and a blue channel) as an example. For example, if only one color channel has an average grayscale value that is not 0, it indicates that the display panel is displaying a monochromatic image. In this case, the total current bias value is not involved, that is, the total current bias value is determined to be 0. If only two color channels have average grayscale values that are not 0, it indicates that the display panel is displaying a non-monochromatic image. In this case, the total current bias value is involved, a total current bias test value at a grayscale corresponding to an average of the two average grayscale values of the two color channels is determined as the total current bias value. If three average grayscale values of the three color channels are not 0, it indicates that the display panel is displaying a non-monochromatic image. In this case, the total current bias value is also involved, a total current bias test value at a grayscale corresponding to an average of the three average grayscale values of the three color channels is determined as the total current bias value. Therefore, the total current bias value Error(p) when the display panel is displaying can be obtained.

Step 290: calculating a display total current prediction value of the image to be displayed, according to the current values of the respective color channels, the current bias values of the respective color channels and the total current bias value applied for the image to be displayed.

Taking that each pixel of the image to be displayed includes a red channel, a green channel and a blue channel as an example, the display total current prediction value of the image to be displayed can be calculated based on a formula as follows:

$$I(p)_\text{total}=I(p)_R+I(p)_G+I(p)_B-\text{deltaR}(p)-\text{deltaG}(p)-\text{deltaB}(p)-\text{Error}(p)$$

where I(p)_R, I(p)_G, I(p)_B, deltaR(p), deltaG(p), deltaB (p), Error(p) are the current value of the red channel, the current value of the green channel, the current value of the blue channel, the current bias value of the red channel, the current bias value of the green channel, the current bias value of the blue channel, the total current bias value, that are determined in step S270 and step S280.

The image display total current prediction method provided by the embodiments of the present disclosure can accurately predict the image display total current (i.e., display total current) of the display panel, and are applicable to various forms of display panels, including but not limited to an organic light-emitting diode display panel, a quantum dot light-emitting diode (QLED) display panel, an inorganic light-emitting diode display panel, etc., and has advantages of simple implementation and low cost.

Figure 5:
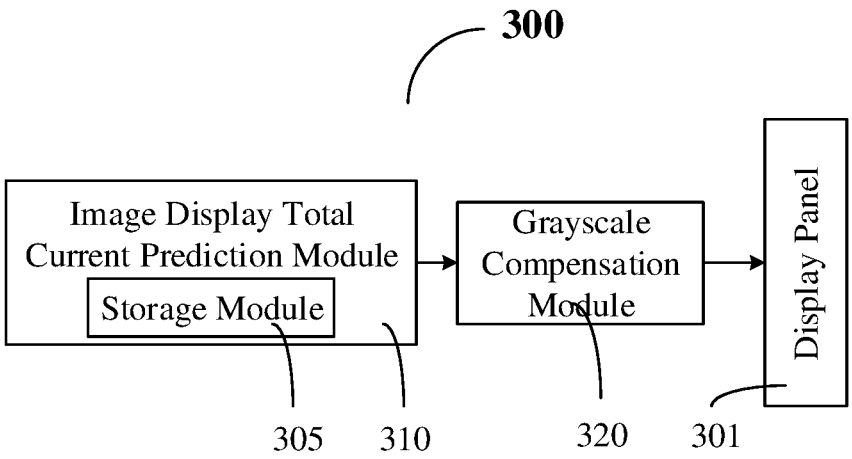
FIG. 5 is a schematic diagram of a display device provided by some embodiments of the present disclosure.

At least one embodiment of the present disclosure further provides a display device, which can be used to predict the display total current of an image to be displayed by using the image display total current prediction method provided by the embodiments of the present disclosure. FIG. 5 is a schematic diagram of a display device provided by some embodiments of the present disclosure.

As shown in FIG. 5, the display device 300 includes an image display total current prediction module 310, which is configured to obtain the display total current prediction value of the image to be displayed by using the image display total current prediction method provided by the embodiments of the present disclosure. For example, as shown in FIG. 5, the image display total current prediction module 310 can further includes a storage module 305, and the storage module 305 can be configured to store the first numerical correspondence relationship, the second numerical correspondence relationship and the third numerical correspondence relationship described above, which is not limitative in the present disclosure.

For example, as shown in FIG. 5, the display device 300 can further include a grayscale compensation module 320. The grayscale compensation module 320 is configured to compensate for the grayscale signals of the respective pixels based on the display total current prediction value of the image to be displayed, the grayscale signals of the respective pixels of the image to be displayed, and a predetermined display total current-grayscale compensation relationship. For example, taking the display total current prediction value of the image to be displayed and the grayscale signals of the respective pixels of the image to be displayed (for example, three color grayscale signals corresponding to the three primary color channels) as an index, grayscale compensation values of the respective pixels can be find from the predetermined display total current-grayscale compensation relationship, and the original grayscale signals can be modified for compensation according to the grayscale compensation values. It should be noted that, in the present embodiment, the compensation method of the grayscale compensation module 320 is not limited, as long as it can compensate for the grayscale signals according to the display total current prediction value of the image to be displayed provided by the image display total current prediction module 310.

For example, as shown in FIG. 5, the display device can further include a display panel 301. The display panel 301 has the same specifications as the tested display panel, which is used to obtain the first numerical correspondence relationship, the second numerical correspondence relationship, and the third numerical correspondence relationship described above, so that the display panel 301 can be compensated by the grayscale compensation module 320. For example, the display device 300 can compensate for the display of the display panel 301 in real time, therefore improving compensation speed and accuracy, and improving compensation performance.

For example, the display device 300 can further include a Demura module (not shown in FIG. 5). The Demura module is configured to eliminate the mura phenomenon caused, for example, by other factors (factors not related to IR drop) during display. For example, after the step of eliminating the mura phenomenon by the Demura module, the display total current of the image to be displayed is predicted by the image display total current prediction module 310, and the display panel 301 is compensated for displaying by the grayscale compensation module 320.

It should be noted that, in the display device 300 shown in FIG. 5, the image display total current prediction module 310, the storage module 305, the grayscale compensation module 320, and the Demura module (not shown in FIG. 5), etc., can be implemented by hardware, software, firmware, or any combination thereof. For example, the display device 300 shown in FIG. 5 can further include a timing controller (TCON), and a data driving integrated circuit (referring to the display device 100 shown in FIG. 1B), etc., so that the image display total current prediction module 310, the storage module 305, the grayscale compensation module 320 and the Demura module can be integrated in the timing controller, or can be integrated in the data driving integrated circuit, or can be disposed between the timing controller and the data driving integrated circuit, which is not limitative in the present disclosure.

Figure 6:
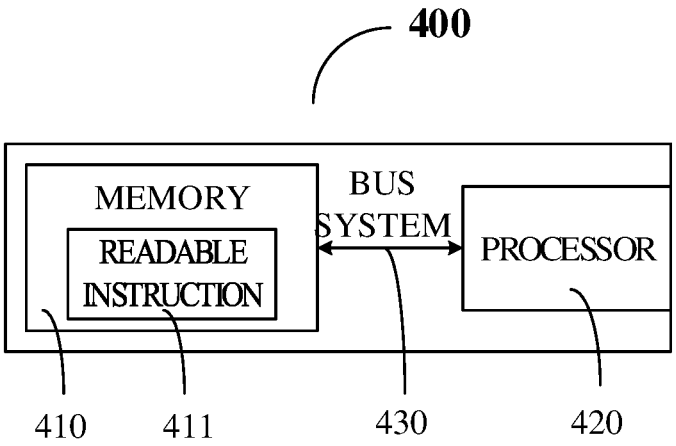
FIG. 6 is schematic diagram of another display device provided by some embodiments of the present disclosure.

FIG. 6 is schematic diagram of another display device provided by some embodiments of the present disclosure. At least one embodiment of the present disclosure further provides a display device. As shown in FIG. 6, the display device 400 includes a memory 410 and a processor 420. The memory 410 is configured to store a computer-readable instruction 411 non-transitorily, and the processor 420 is configured to execute the computer-readable instruction 411. Upon the computer readable instruction 411 being executed by the processor 420, the image display total current prediction method provided by the embodiments of the present disclosure are executed.

For example, the memory 410 is connected to the processor 420 via a bus system 430. For example, one or a plurality of computer-readable instructions 411 can be stored in the memory 410. For example, the one or the plurality of computer-readable instructions 411 can include instructions for executing the image display total current prediction method provided by any one of the embodiments of the present disclosure. For example, the one or the plurality of computer-readable instructions 411 can be executed by the processor 420. For example, the bus system 430 can be a commonly used serial, parallel communication bus, etc., and which is not limitative in the embodiments of the present disclosure.

For example, the processor 420 can be a central processing unit (CPU), a field programmable gate array (FPGA), or a processing unit of other form with data processing capability and/or instruction execution capability, which may be a general-purpose processor or a dedicated processor, and is capable of controlling other components in the display device 400 to perform the desired functions.

The memory 410 can include one or a plurality of computer program products, and the computer program products can include a computer-readable storage medium of diverse forms, such as a volatile memory and/or a non-volatile memory. The volatile memory can include, for example, a random access memory (RAM) and/or a cache, etc. The non-volatile memory can include, for example, a read-only memory (ROM), a hard disk, a flash memory, etc. One or a plurality of computer-readable instructions can be stored on the computer-readable storage medium, and the processor 420 can run the computer-readable instructions to achieve the function (achieved by the processor 420) in the embodiments of the present disclosure and/or other desired function, such as, image display total current prediction and so on. Various application programs and various data, such as the first numerical correspondence relationship, the second numerical correspondence relationship, and the third numerical correspondence relationship described above, can also be stored in the computer-readable storage medium.

It should be noted that the present embodiment does not illustrate the whole components, units or modules of the display device 400. For example, the display device 400 can further include a display panel, a grayscale compensation module, etc., so that the display device 400 can also achieve the same function as the display device 300 shown in FIG. 5, that is, the display device 400 can not only predict the display total current of an image to be displayed accurately, but also compensate for the display of the display panel in real time, and details are not repeatedly described herein.

It should be noted that, in order to be clear and concise, the embodiments of the present disclosure do not illustrate the whole components, units or modules of the display device (for example, the display device 300 shown in FIG. 5 and the display device 400 shown in FIG. 6). In order to achieve necessary functions of the display device, those skilled in the art can provide and arrange other components, units or modules that are not shown (for example, the interface circuit, the timing controller and the data driving integrated circuit in the display device 100 shown in FIG. 1B), and the embodiments of the present disclosure are not limited to the described cases.

It should be noted that, the display device in the embodiments of the present disclosure can be any products or components having a display function, such as a display, a television, an electronic paper display device, a mobile phone, a tablet computer, a notebook computer, a digital photo frame, a navigator, etc. It should be noted that, the display device can also include other conventional components or structures. For example, in order to implement necessary functions of the display device, those skilled in the art can set other conventional components or structures according to specific application scenarios, which is not limitative in the embodiments of the present disclosure.

Technical effects of the display device provided by the embodiments of the present disclosure can be referred to the related description of the image display total current prediction method in the aforementioned embodiments, and are not described here again.

Figure 7:
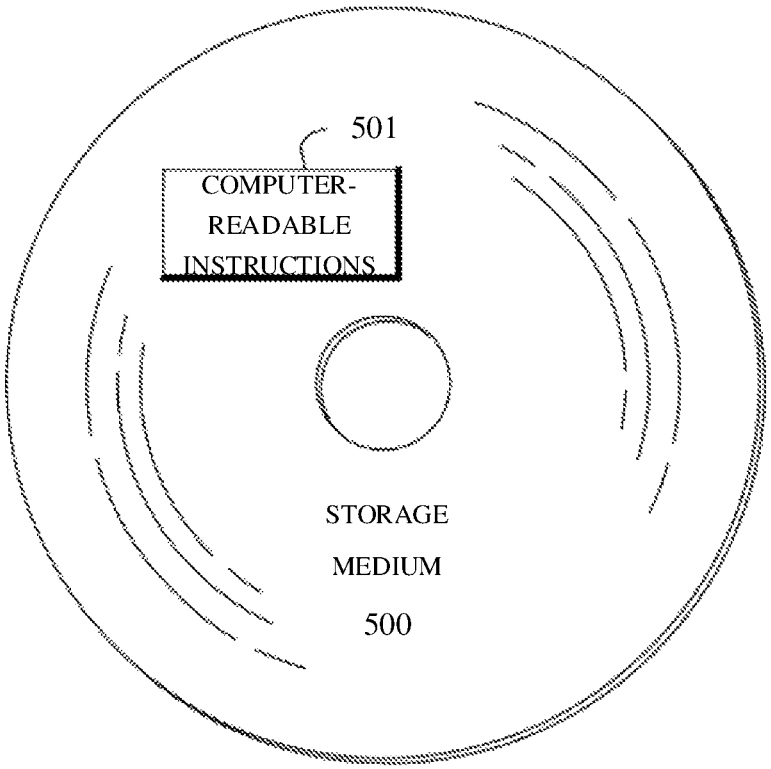
FIG. 7 is a schematic diagram of a storage medium provided by some embodiments of the present disclosure.

Some embodiments of the present disclosure further provide a storage medium. FIG. 7 is a schematic diagram of a storage medium provided by some embodiments of the present disclosure. For example, the storage medium 500 can store computer-readable instructions 501 non-transitorily. Upon the computer-readable instructions 501 stored non-transitorily being executed by a computer (including a processor), the image display total current prediction method provided by any one of the embodiments of the present disclosure can be executed.

For example, the storage medium is any combination of one or a plurality of computer-readable storage media. For example, one computer-readable storage medium includes computer-readable program codes and data of the first numerical correspondence relationship, the second numerical correspondence relationship and the third numerical correspondence relationship described above. For example, another computer-readable storage medium includes computer-readable program codes used for executing the image display total current prediction method shown in FIG. 2. For example, in a case where the program code is read by the computer, the program code stored in the computer-readable storage medium is executed by the computer, and for example, the image display total current prediction method shown in FIG. 2 is executed, so as to predict the display total current of an image to be displayed.

For example, the storage medium can include a storage component of a tablet, a hard disk of a personal computer, a random access memory (RAM), a read-only memory (ROM), a erasable programmable read-only memory (EPROM), a portable compact disk read-only memory (CD-ROM), a flash memory, or any combination of the above-mentioned storage media, or other suitable storage medium.

Technical effects of the storage medium provided by the embodiments of the present disclosure can be referred to the related description of the image display total current prediction method in the aforementioned embodiments, and are not described here again.

For the disclosure, the following statements should be noted:

(1) The accompanying drawings related to the embodiment(s) of the present disclosure involve only the structure(s) in connection with the embodiment(s) of the present disclosure, and other structure(s) can be referred to common design(s).

(2) In case of no conflict, features in one embodiment or in different embodiments can be combined.

What have been described above are only specific implementations of the present disclosure, and the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be determined based on the protection scope of the claims.

What is claimed is:

1. An image display total current prediction method, comprising:

obtaining grayscale signals of respective pixels of an image to be displayed, each of the respective pixels comprising multiple color channels, and the grayscale signal of each of the respective pixels comprising multiple color grayscale signals corresponding to the multiple color channels, respectively;

calculating average grayscale values of respective color channels of the image to be displayed, respectively, according to the grayscale signals of the respective pixels of the image to be displayed;

determining current values of the respective color channels, current bias values of the respective color channels and a total current bias value applied for the image to be displayed, respectively, according to the average grayscale values of the respective color channels of the image to be displayed;

calculating a display total current prediction value of the image to be displayed, according to the current values of the respective color channels, the current bias values of the respective color channels and the total current bias value applied for the image to be displayed.

2. The image display total current prediction method according to claim 1, wherein the display total current prediction value is a difference value obtained by subtracting a sum of the current bias values of the respective color channels from a sum of the current values of the respective color channels and then subtracting the total current bias value.

3. The image display total current prediction method according to claim 1, further comprising:

obtaining test data of a plurality of band point grayscales of the display panel, the plurality of band point grayscales comprising an upper bound grayscale, a lower bound grayscale and a plurality of intermediate grayscales, the test data comprising image current test values upon displaying predetermined color images at each band point grayscale;

determining current test values of the respective color channels at each band point grayscale, calculating current bias test values of the respective color channels at each band point grayscale, and calculating a total current bias test value at each band point grayscale, according to the test data.

4. The image display total current prediction method according to claim 3, further comprising:

according to the current test values of the respective color channels at each band point grayscale, obtaining current test values of the respective color channels at other grayscales by interpolation calculation, so as to obtain a first numerical correspondence relationship between the current test values of the respective color channels and the grayscales;

according to the current bias test values of the respective color channels at each band point grayscale, obtaining current bias test values of the respective color channels at other grayscales by interpolation calculation, so as to obtain a second numerical correspondence relationship between the current bias test values of the respective color channels and the grayscales;

according to the total current bias test value at each band point grayscale, obtaining total current bias test values at other grayscales by interpolation calculation, so as to obtain a third numerical correspondence relationship between the total current bias test values and the grayscales.

5. The image display total current prediction method according to claim 4, wherein the multiple color channels comprises three color channels corresponding to three primary colors, respectively;

determining the current values of the respective color channels, the current bias values of the respective color channels and the total current bias value applied for the image to be displayed, respectively, according to the average grayscale values of the respective color channels of the image to be displayed, comprises:

determining the current values of the respective color channels according to the average grayscale values of the respective color channels of the image to be displayed and the first numerical value correspondence relationship;

determining the current bias values of the respective color channels according to the average grayscale values of the respective color channels of the image to be displayed and the second numerical value correspondence relationship;

determining the total current bias value according to the average grayscale values of the respective color channels of the image to be displayed and the third numerical value correspondence relationship.

6. The image display total current prediction method according to claim 5, wherein determining the current values of the respective color channels according to the average grayscale values of the respective color channels of the image to be displayed and the first numerical value correspondence relationship comprises:

determining current test values of the respective color channels at grayscales corresponding to the average grayscale values of the respective color channels as the current values of the respective color channels.

7. The image display total current prediction method according to claim 5, wherein determining the current bias values of the respective color channels according to the average grayscale values of the respective color channels of the image to be displayed and the second numerical value correspondence relationship comprises:

judging whether the average grayscale values of the respective color channels are 0 or not;

if only one color channel has an average grayscale value that is not 0, determining the current bias value of the one color channel as 0;

otherwise, determining current bias test values of the respective color channels at grayscales corresponding to the average grayscale values of the respective color channels as the current bias values of the respective color channels.

8. The image display total current prediction method according to claim 5, wherein determining the total current bias value according to the average grayscale values of the respective color channels of the image to be displayed and the third numerical value correspondence relationship comprises:

if only one color channel has an average grayscale value that is not 0, determining the total current bias value as 0;

if only two color channels have average grayscale values that are not 0, determining a total current bias test value at a grayscale corresponding to an average of the two average grayscale values of the two color channels as the total current bias value;

if three average grayscale values of the three color channels are all not 0, determining a total current bias test value at a grayscale corresponding to an average of the three average grayscale values of the three color channels as the total current bias value.

9. The image display total current prediction method according to claim 5, wherein the three color channels include a red channel, a green channel and a blue channel, and the predetermined color images include red, green, blue, white, cyan, magenta and yellow images.

10. The image display total current prediction method according to claim 9, wherein determining the current test values of the respective color channels at each band point grayscale according to the test data comprises:

determining an image current test value of a red image at each band point grayscale as the current test value of the red channel at the each band point grayscale;

determining an image current test value of a green image at each band point grayscale as the current test value of the green channel at the each band point grayscale;

determining an image current test value of a blue image at each band point grayscale as the current test value of the blue channel at each band point grayscale.

11. The image display total current prediction method according to claim 10, wherein calculating the current bias test values of the respective color channels at each band point grayscale and calculating the total current bias test value at each band point grayscale according to the test data comprises:

calculating the current bias test values of the respective color channels at each band point grayscale and calculating the total current bias test value at each band point grayscale according to formulas as follows:

$$\begin{cases} deltaR = I_R + I_C - I_W \\ deltaG = I_G + I_M - I_W \\ deltaB = I_B + I_Y - I_W \\ Error = 2 * I_W - (I_C + I_M + I_Y) \end{cases}$$

where deltaR is the current bias test value of the red channel at each band point grayscale, deltaG is the current bias test value of the green channel at each band point grayscale, deltaB is the current bias test value of the blue channel at each band point grayscale, Error is the total current bias test value at each band point grayscale, I_R is an image current test value of displaying a red image at each band point grayscale, I_G is an image current test value of displaying a green image at each band point grayscale, I_B is an image current test value of displaying a blue image at each band point grayscale, I_W is an image current test value of displaying a white image at each band point grayscale, I_C is an image current test value of displaying a cyan image at each band point grayscale, I_M is an image current test value of displaying a magenta image at each band point grayscale, and I_Y is an image current test value of displaying a yellow image at each band point grayscale.

12. A display device, comprising:

an image display total current prediction module, configured to obtain the display total current prediction value of the image to be displayed by using the image display total current prediction method according to claim 1.

13. The display device according to claim 12, further comprising:

a grayscale compensation module, configured to compensate for the grayscale signals of the respective pixels based on the display total current prediction value of the image to be displayed, the grayscale signals of the respective pixels of the image to be displayed, and a predetermined display total current-grayscale compensation relationship.

14. A display device, comprising:

an image display total current prediction module, configured to obtain the display total current prediction value of the image to be displayed by using the image display total current prediction method according to claim 5.

15. The display device according to claim 14, wherein the image display total current prediction module comprises a storage module, the storage module is configured to store the first numerical correspondence relationship, the second numerical correspondence relationship and the third numerical correspondence relationship.

16. The display device according to claim 15, further comprising:

a grayscale compensation module, configured to compensate for the grayscale signals of the respective pixels based on the display total current prediction value of the image to be displayed, the grayscale signals of the respective pixels of the image to be displayed, and a predetermined display total current-grayscale compensation relationship.

17. A display device, comprising:

a memory, configured to store a computer-readable instruction non-transitorily; and a processor, configured to execute the computer-readable instruction, upon the computer readable instruction being executed by the processor, the image display total current prediction method according to claim 1 being executed.

18. A storage medium, storing computer-readable instructions non-transitorily, upon the computer-readable instructions stored non-transitorily being executed by a computer, instructions for the image display total current prediction method according to claim 1 being executed.

* * * * *